US008861753B2

(12) United States Patent
Kasai et al.

(10) Patent No.: US 8,861,753 B2
(45) Date of Patent: Oct. 14, 2014

(54) ACOUSTIC TRANSDUCER, AND MICROPHONE USING THE ACOUSTIC TRANSDUCER

(75) Inventors: Takashi Kasai, Kusatsu (JP); Yuki Uchida, Kyoto (JP); Yasuhiro Horimoto, Kusatsu (JP); Sebastiano Conti, Messina (IT)

(73) Assignees: OMRON Corporation, Kyoto-Shi, Kyoto (JP); STMicroelectronics Srl, Agrate Brianza Milano (IT)

( * ) Notice: Subject to any disclaimer, the term of this patent is extended or adjusted under 35 U.S.C. 154(b) by 0 days.

(21) Appl. No.: 13/699,932

(22) PCT Filed: May 10, 2011

(86) PCT No.: PCT/JP2011/060714

§ 371 (c)(1),
(2), (4) Date: Nov. 26, 2012

(87) PCT Pub. No.: WO2011/148778

PCT Pub. Date: Dec. 1, 2011

(65) Prior Publication Data

US 2013/0070942 A1 Mar. 21, 2013

(30) Foreign Application Priority Data

May 27, 2010 (JP) ..... 2010-121680

(51) Int. Cl.
*H04R 3/00* (2006.01)

(52) U.S. Cl.
USPC ..... 381/162; 381/357; 381/359; 381/189; 381/174

(58) Field of Classification Search
USPC ..... 381/162, 189, 191, 357, 359, 174; 181/198, 199, 205
See application file for complete search history.

(56) References Cited

U.S. PATENT DOCUMENTS 5,870,482 A * 2/1999 Loeppert et al. ..... 381/174
2006/0022285 A1 2/2006 Matsubara et al.

(Continued)

FOREIGN PATENT DOCUMENTS

CN 1926918 A 3/2007
CN 101360354 A 2/2009

(Continued)

OTHER PUBLICATIONS

Extended European Search Report issued in European Appliation No. 11786478.5, mailing date Mar. 15, 2013 (7 pages).

(Continued)

*Primary Examiner* — Curtis Kuntz
*Assistant Examiner* — Joshua A Kaufman
(74) *Attorney, Agent, or Firm* — Osha Liang LLP

(57) ABSTRACT

An acoustic sensor includes: a semiconductor substrate; a vibrating membrane, formed above the semiconductor substrate, which includes a vibrating electrode; and a fixed membrane, formed on an upper surface of the semiconductor substrate, which includes a fixed electrode, the acoustic sensor detecting an acoustic wave according to a change in capacitance between the vibrating electrode and the fixed electrode. The fixed membrane has a plurality of sound hole portions formed therein in order to allow the acoustic wave to reach the vibrating membrane from outside, and the fixed electrode is formed so that a boundary of an edge portion of the fixed electrode does not intersect the sound hole portions.

8 Claims, 8 Drawing Sheets

(56) References Cited

U.S. PATENT DOCUMENTS

| | | | | |
|---|---|---|---|---|
| 2007/0189555 | A1 | 8/2007 | Yamaoka et al. | |
| 2007/0189558 | A1 | 8/2007 | Ogura et al. | |
| 2009/0034760 | A1 | 2/2009 | Minamio et al. | |
| 2009/0080682 | A1 | 3/2009 | Ogura et al. | |
| 2011/0044480 | A1 | 2/2011 | Yamaoka et al. | |
| 2011/0140213 | A1 | 6/2011 | Kasia et al. | |
| 2012/0237061 | A1* | 9/2012 | Corona et al. | 381/122 |

FOREIGN PATENT DOCUMENTS

| | | | |
|---|---|---|---|
| EP | 1722595 | A1 | 11/2006 |
| EP | 2182738 | A1 | 5/2010 |
| EP | 2328361 | A1 | 6/2011 |
| JP | 2006-67547 | A | 3/2006 |
| JP | 2008-53400 | A | 3/2008 |
| JP | 2008-113057 | A | 5/2008 |
| JP | 2009-38732 | A | 2/2009 |
| WO | 2005/086535 | A1 | 9/2005 |
| WO | 2010/023776 | A1 | 3/2010 |

OTHER PUBLICATIONS

International Search Report issued in PCT/JP2011/060714 mailed Jul. 5, 2011 (4 pages).

Written Opinion issued in PCT/JP2011/060714 mailed Jul. 5, 2011 (3 pages).

Office Action dated Jul. 30, 2014 in corresponding Chinese Application No. 201180026170.1 (with translation) (12 pages).

* cited by examiner

ACOUSTIC TRANSDUCER, AND MICROPHONE USING THE ACOUSTIC TRANSDUCER

CROSS-REFERENCE TO RELATED APPLICATION

This application is a National Stage of International Application No. PCT/JP2011/060714, filed on May 10, 2011. The contents of which is expressly incorporated herein by reference in its entirety.

TECHNICAL FIELD

The present invention relates to an acoustic transducer that converts an acoustic wave into an electrical signal, and to a microphone using the acoustic transducer. In particular, the present invention relates to an acoustic transducer with a micro size, which is fabricated by using a MEMS (Micro Electro Mechanical System) technique, and the like.

BACKGROUND ART

Conventionally, an ECM (Electret Condenser Microphone) has been widely used as a small-sized microphone that is mounted on a cellular phone or the like. However, the ECM is weak against heat, and a MEMS microphone is superior in terms of coping with digitalization, of miniaturization, of enhancement of functionality/multi-functionality, and of power saving. Accordingly, at present, the MEMS microphone is becoming widespread.

The MEMS microphone includes an acoustic sensor (acoustic transducer) that detects an acoustic wave, and an output IC (Integrated Circuit) that amplifies a detection signal from the acoustic sensor and outputs the detection signal thus amplified to outside. This acoustic sensor is manufactured by using the MEMS technique (for example, Patent Literature 1 and the like).

FIG. 8 schematically shows a configuration of a conventional acoustic sensor. (a) of FIG. 8 is a plan view, and (b) of FIG. 8 is a cross-sectional view taken along the line X-X of (a) of FIG. 8 as viewed in the direction of the arrows. As shown in FIG. 8, an acoustic sensor 111 includes: a semiconductor substrate 21; a vibrating membrane 22 provided above the semiconductor substrate 21; and a fixed membrane 123 provided so as to cover the vibrating membrane 22. The vibrating membrane 22 is a conductor, and functions as a vibrating electrode 22*a*. Meanwhile, the fixed membrane 123 includes: a fixed electrode 123*a*, which serves as a conductor; and a protecting membrane 123*b*, which serves as an insulator for protecting the fixed electrode 123*a*. The vibrating electrode 22*a* and the fixed electrode 123*a* are opposed to each other with a gap sandwiched therebetween, and function as a capacitor.

The vibrating membrane 22 has an edge portion attached to the semiconductor substrate 21 with an insulating layer 30 sandwiched therebetween. Moreover, the semiconductor substrate 21 has an opening 31 made by opening a region opposed to a central part of the vibrating membrane 22. Furthermore, the fixed membrane 123 has a large number of sound hole portions 32 in which sound holes are formed. Normally, the sound hole portions 32 are regularly arrayed at equal intervals, and the sound holes in their respective sound hole portions 32 are of substantially equal in size to one another.

In the acoustic sensor 111 thus configured, the acoustic wave from the outside reaches the vibrating membrane 22 through the sound hole portions 32 of the fixed membrane 123. At this time, since the application of a sound pressure of the reached acoustic wave causes the vibrating membrane 22 to vibrate, the distance between the vibrating electrode 22*a* and the fixed electrode 123*a* changes, so that the capacitance between the vibrating electrode 22*a* and the fixed electrode 123*a* changes. By converting such a change in capacitance into a change in voltage or in current, the acoustic sensor 111 can detect the acoustic wave from the outside and convert the detected acoustic wave into an electrical signal (detection signal).

The acoustic sensor 111 thus configured has the large number of sound hole portions 32 in the fixed membrane 123. Besides allowing the acoustic wave from the outside to pass therethrough and to reach the vibrating membrane 22, the sound hole portions 32 function as follows:

(1) The acoustic wave that has reached the fixed membrane 123 passes through the sound hole portions 32, and accordingly, the sound pressure to be applied to the fixed membrane 123 is reduced.

(2) Air between the vibrating membrane 22 and the fixed membrane 123 goes in and out through the sound hole portions 32, and accordingly, thermal noise (air fluctuations) is reduced. Moreover, damping of the vibrating membrane 22, which is caused by the air, is reduced, and accordingly, a deterioration in high-frequency characteristics by the damping is reduced.

(3) The sound hole portions 32 can be used as etching holes in the case of formation of the gap between the vibrating electrode 22*a* and the fixed electrode 123*a* by use of a surface micromachining technique.

CITATION LIST

Patent Literature 1

Japanese Patent Application Publication, Tokukai, No. 2006-067547 A (Publication Date: Mar. 9, 2006)

SUMMARY OF INVENTION

Technical Problem

In order to further make the MEMS microphone widespread in the future, it is desirable to improve the impact resistance of the MEMS microphone and thereby lower the failure rate and increase yields. As a result of their diligent study, the inventors of the present application have focused on the fact that a stress concentration occurs in the sound hole portions, and have devised the following invention.

The present invention has been made in view of the above problems, and it is an object of the present invention to provide an acoustic transducer with improved resistance to impact, etc.

Solution to Problem

An acoustic transducer according to the present invention includes: a substrate; a vibrating membrane, formed above the substrate, which includes a vibrating electrode; and a fixed membrane, formed on an upper surface of the substrate, which includes a fixed electrode, the acoustic transducer converting an acoustic wave into an electrical signal according to a change in capacitance between the vibrating electrode and the fixed electrode, the fixed membrane having a plurality of sound hole portions formed therein in order to allow the acoustic wave to reach the vibrating membrane from outside, the fixed electrode being formed so that a boundary of an edge portion of the fixed electrode does not intersect the sound hole portions.

According to the above configuration, there is no sound hole portion intersecting the boundary of the fixed electrode on the edge potion of the fixed electrode. This makes it possible to avoid damage due to a stress concentration on the edge portion of the fixed electrode and, accordingly, improve resistance to impact.

Advantageous Effects of Invention

As described above, the acoustic transducer according to the present invention is formed so that the boundary of the edge portion of the fixed electrode does not intersect the sound hole portions. This makes it possible to avoid damage due to a stress concentration on the edge portion of the fixed electrode and, as a result, brings about an effect of improving resistance to impact.

BRIEF DESCRIPTION OF DRAWINGS

FIG. 1 shows a plan view (a) and a cross-sectional view (b), which schematically show a configuration of an acoustic sensor in a MEMS microphone according to an embodiment of the present invention.

FIG. 2 is a cross-sectional view showing the MEMS microphone.

FIG. 3 shows combinations (a) to (c) of a plan view and a front view, each of which shows a block for describing a place where a stress concentration is occurring.

FIG. 4 is a plan view schematically showing a configuration of an acoustic sensor in a MEMS microphone according to another embodiment of the present invention.

FIG. 5 is a set of plan views (a) and (b), (a) schematically showing a configuration of an acoustic sensor in a MEMS microphone according to still another embodiment of the present invention, (b) schematically showing a configuration of a conventional acoustic sensor serving as a comparative example of the acoustic sensor.

FIG. 6 is a plan view schematically showing a configuration of an acoustic sensor in a MEMS microphone according to another embodiment of the present invention.

FIG. 7 is a plan view showing an amount of vibration of a vibrating electrode of the acoustic sensor.

FIG. 8 includes a plan view schematically showing the configuration of the conventional acoustic sensor.

DESCRIPTION OF EMBODIMENTS

[Embodiment 1]

Figure 1:
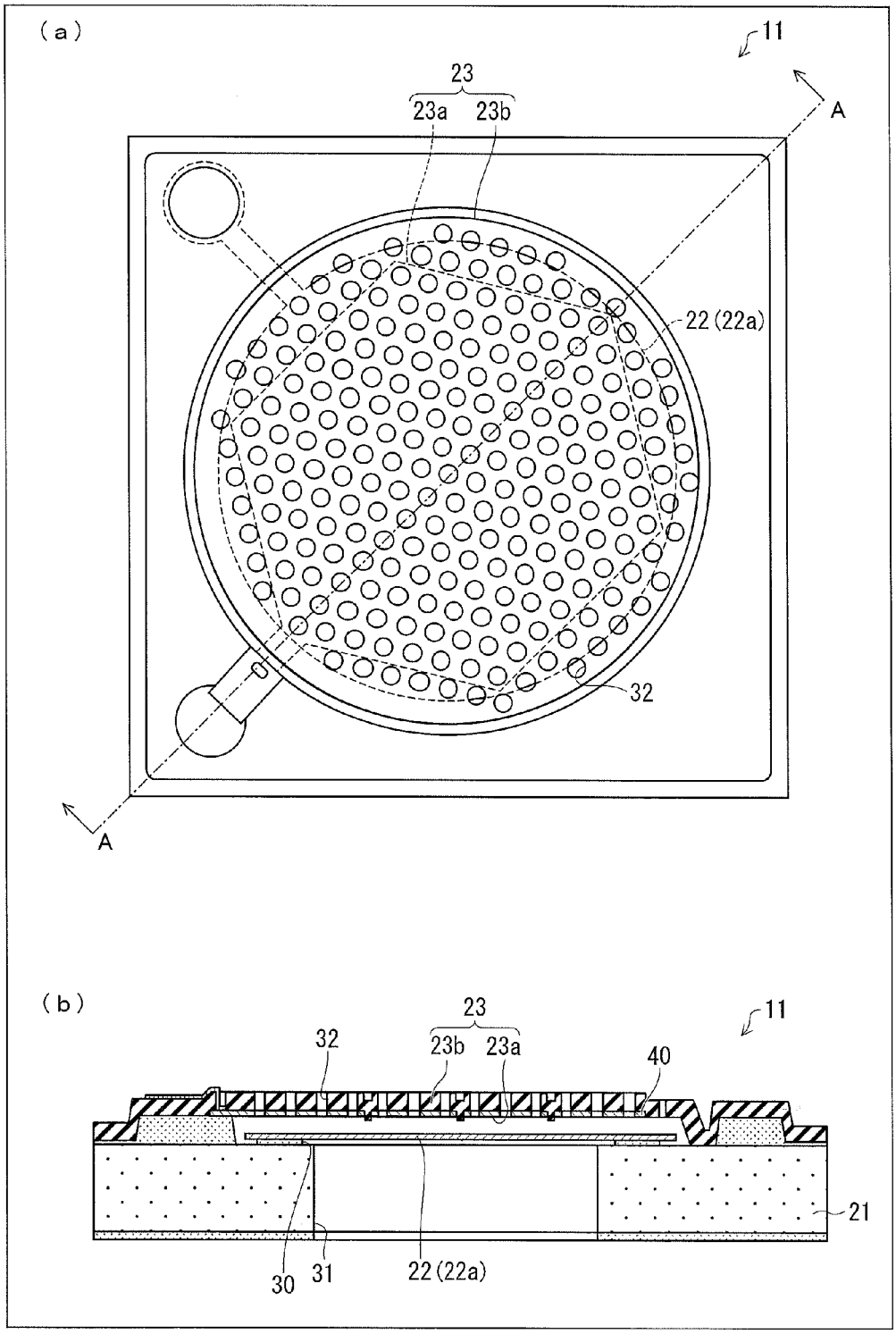
FIG. 1

An embodiment of the present invention is described with reference to FIG. 1 through FIG. 3. FIG. 2 is a cross-sectional view schematically showing a configuration of a MEMS microphone of the present embodiment.

As shown in FIG. 2, a MEMS microphone 10 includes: an acoustic sensor (acoustic transducer) 11 that detects an acoustic wave; an output IC 12 that amplifies a detection signal (electrical signal) from the acoustic sensor 11 and outputs the detection signal thus amplified to outside; a printed board 13 on which the acoustic sensor 11 and the output IC 12 are disposed; and a cover 14 provided so as to covering the acoustic sensor 11 and the output IC 12. The cover 14 has a through hole 15 formed therein in order to allow the acoustic wave from the outside to reach the acoustic sensor 11. The acoustic sensor 11 is manufactured by using a MEMS technique. Note that the output IC 12 is manufactured by using a semiconductor manufacturing technique.

Figure 2:
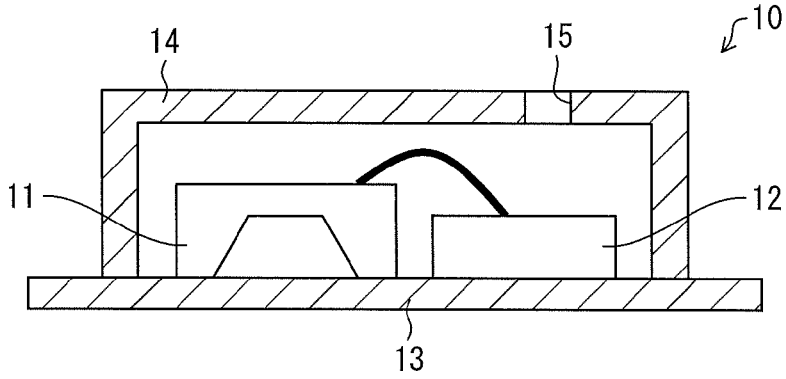
FIG. 2

FIG. 1 schematically shows a configuration of the acoustic sensor 11 in the present embodiment. (a) of FIG. 1 is a plan view, and (b) of FIG. 1 is a cross-sectional view taken along the line A-A of (a) of FIG. 1 as viewed in the direction of the arrows.

Figure 8A:
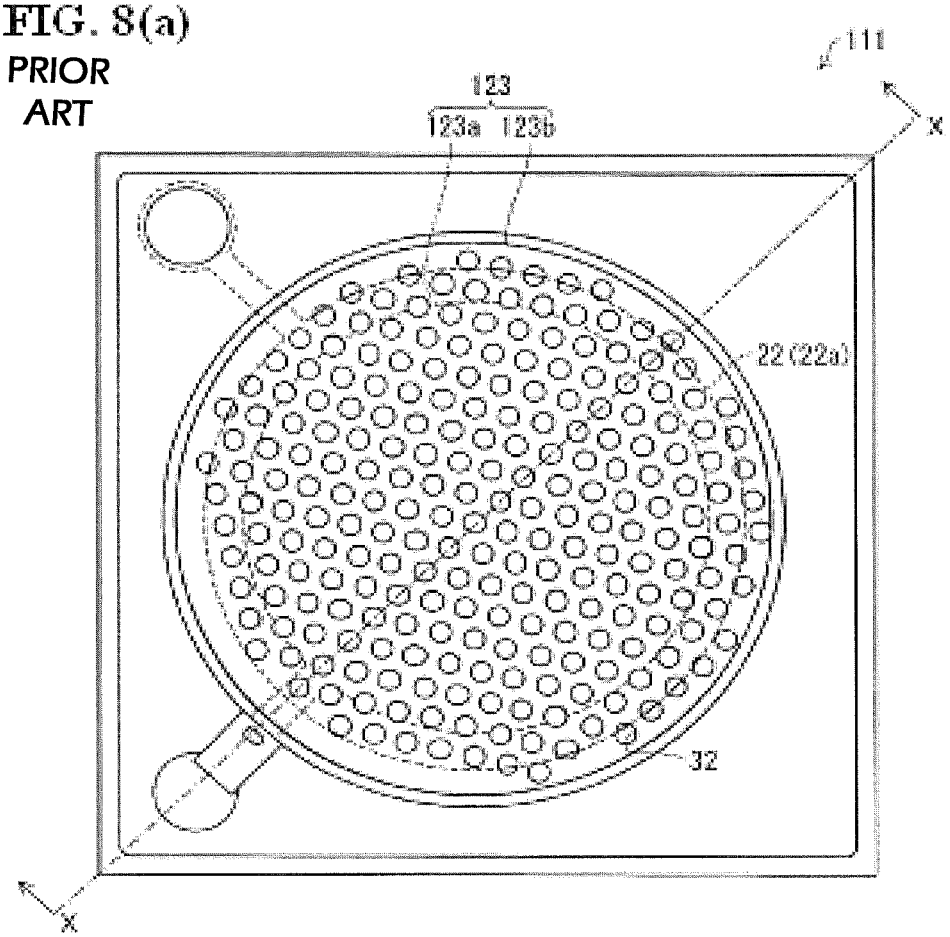
FIG. 8(a) PRIOR ART
FIG. 8
Figure 8B:
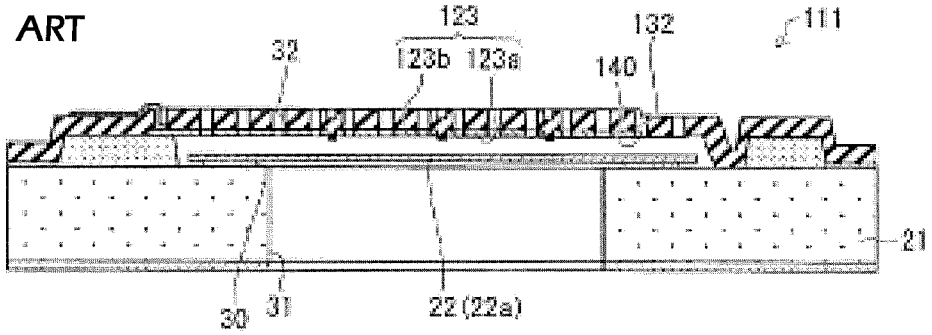
FIG. 8(b) PRIOR ART

The acoustic sensor 11 of the present embodiment is different from the acoustic sensor 111 shown in FIG. 8 only in the shape of the fixed electrode of the fixed membrane, and the other components of the acoustic sensor 11 are the same as those of the acoustic sensor 111. Note that components having the same functions as those of the components described with reference to FIG. 8 are given the same reference signs, and as such, are not described below.

A fixed membrane 23 includes: a fixed electrode 23*a*, which serves as a conductor; and a protecting membrane 23*b*, which serves as an insulator for protecting the fixed electrode 23*a*.

Note that, in the embodiment, a semiconductor substrate 21 is a semiconductor having a thickness of approximately 500 μm and generated from monocrystalline silicon and the like. A vibrating membrane 22 is a conductor having a thickness of approximately 0.7 μm and generated from polycrystalline silicon and the like. The vibrating membrane 22 functions as a vibrating electrode 22*a*. The fixed membrane includes the fixed electrode 23*a* and the protecting membrane 23*b*. The fixed electrode 23*a* is a conductor having a thickness of approximately 0.5 μm and generated from polycrystalline silicon and the like. Meanwhile, the protecting membrane 23*b* is an insulator having a thickness of approximately 2 μm and generated from silicon nitride and the like. Moreover, a gap between the vibrating electrode 22*a* and the fixed electrode 23*a* is approximately 4 μm.

In comparison with the conventional fixed electrode 123*a* shown in FIG. 8, the fixed electrode 23*a* of the present embodiment is formed so that a boundary of an edge portion 40 of the fixed electrode 23*a* does not intersect sound hole portions 32. This makes it possible to avoid damage due to a stress concentration on the edge portion 40 of the fixed electrode 23*a* and, accordingly, improve resistance to impact.

This matter is described in detail with reference to FIGS. 1, 3, and 8. In general, in order to reduce stray capacitance, it is desirable that the fixed electrodes 23*a* and 123*a* be opposed to a region where the vibrating electrode 22*a* vibrates, that is, a central part of the vibrating electrode 22*a*. Meanwhile, it is desirable that a large number of sound hole portions 32 be provided in the fixed electrodes 23 and 123 also in order to efficiently transmit the acoustic wave from the outside to the vibrating membrane 22.

Therefore, as shown in FIG. 8, in the conventional fixed membrane 123, a region where the sound hole portions 32 are provided is wider than a region of the fixed electrode 123*a*, so it is possible that there can be sound hole portions 32 intersecting a boundary line of the fixed electrode 123*a*. The sound hole portions 32 are placed under a large stress concentration.

A cause of such a large stress concentration is described with reference to FIG. 3. FIG. 3 shows combinations (a) to (c) of a plan view and a front view, each of which shows a block for describing a place where a stress concentration is occurring. A block 200 shown in (a) of FIG. 3 has a step portion 201 on an upper surface thereof. A block 210 shown in (b) of FIG. 3 has a pass-through portion 211 that passes through the block 210 from an upper surface thereof to a lower surface thereof. A block 220 shown in (c) of FIG. 3 has a step portion 221 on an upper surface thereof, and has a pass-through portion 222 that passes through the block 220 from an upper surface thereof to a lower surface thereof.

Figure 3:
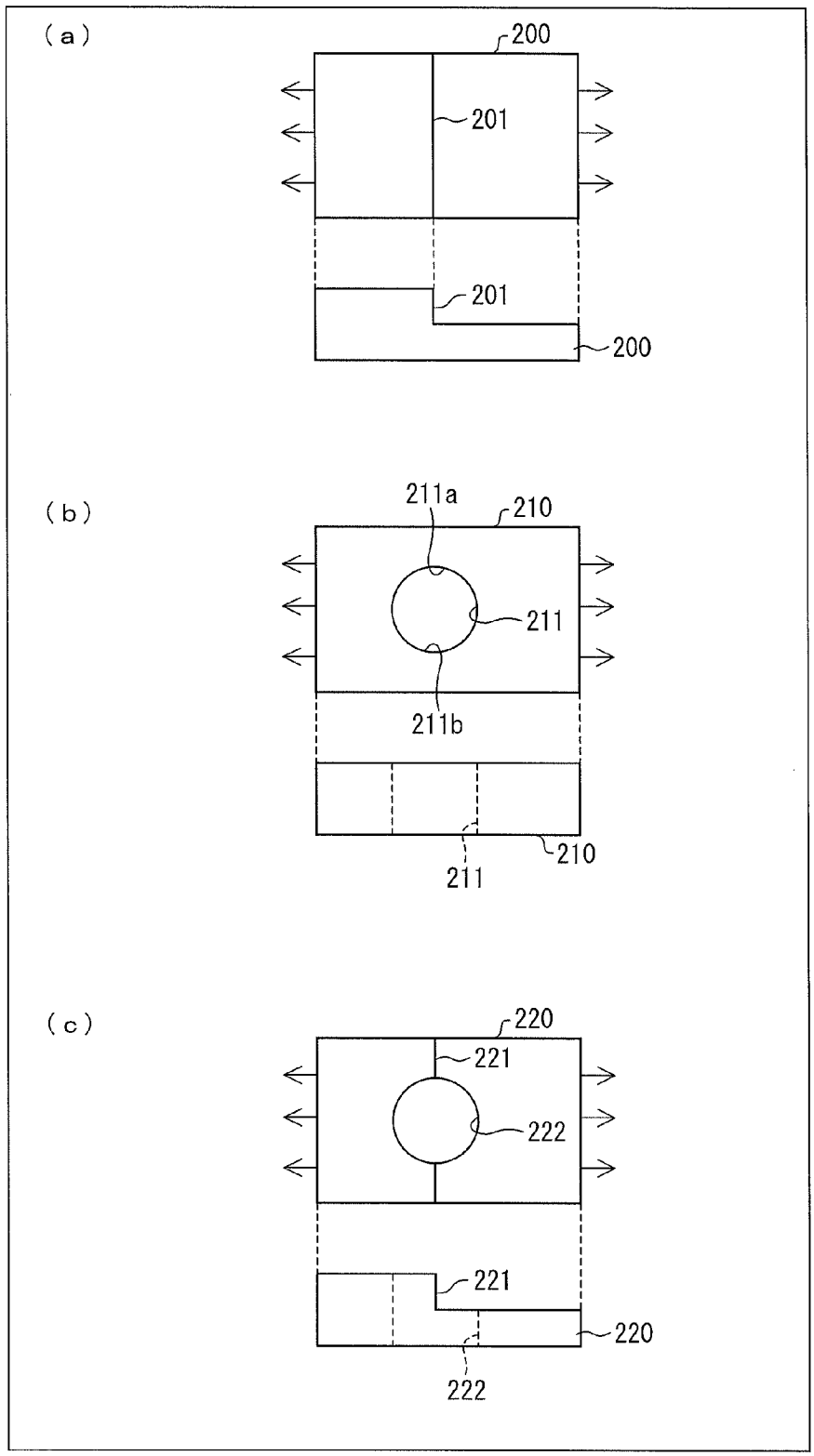
FIG. 3

When a stress is applied in the illustrated rightward and leftward directions to the block 200 shown in (a) of FIG. 3, a stress concentration will occur in the step portion 201. Moreover, when a stress is applied in the illustrated rightward and leftward directions to the block 210 shown in (b) of FIG. 3, a stress concentration will occur in a front portion 21 la and a rear portion 211*b* of the pass-through portion 211. Hence, when a stress is applied in the illustrated rightward and leftward directions to the block 220 shown in (c) of FIG. 3, a strong stress concentration will occur in a region where the step portion 221 and the pass-through portion 222 intersect each other.

When the acoustic sensor 111 is manufactured, the fixed membrane 23, 123 generates a layer of the fixed electrode 23*a*, 123*a*, and generates a layer of the protecting membrane 23*b* so as to cover the fixed electrode 23*a*, 123*a* thus generated. Therefore, as shown in (b) of FIG. 8 and (b) of FIG. 1, on an edge portion 140 of the fixed electrode 23*a*, 123*a*, the protecting membrane 23*b* is in the shape of a step.

Hence, as shown in (b) of FIG. 8, when the sound hole portions 132 are present on the edge portion 140 of the fixed electrode 123*a*, each of the sound hole portions 132 is in such a shape as shown in (c) of FIG. 3, and accordingly, a strong stress concentration occurs. For this reason, the conventional acoustic sensor 111 suffers from damage to the fixed membrane 123 due to such a strong stress concentration and, accordingly, becomes low in resistance to impact.

As opposed to this, in the fixed membrane 23 of the present embodiment, as shown in (b) of FIG. 1, the sound hole portions 32 are not present on the edge portion 40 of the fixed electrode 23*a*, and accordingly, a strong stress concentration does not occur. Hence, as mentioned above, the acoustic sensor 11 of the present embodiment can avoid damage to the fixed membrane 23 due to a strong stress concentration and, accordingly, can improve resistance to impact. In a simulation, if a degree of stress concentration (i.e., a stress concentration coefficient) on the conventional fixed electrode 123*a*, in which the boundary of the end portion 140 intersects the sound hole portions 132, was defined as 1, then a degree of stress concentration on the fixed electrode 23*a* of the present embodiment, in which the boundary of the edge portion 40 does not intersect the sound hole portions 32, was approximately 0.6.

Moreover, in order that the boundary of the edge portion 40 does not intersect the sound hole portions 32, the fixed electrode 23*a* of the present embodiment is in a polygonal shape that lies substantially within the circular vibrating electrode 22*a*, with each side extending parallel to an array direction of the sound hole portions 32. Specifically, the sound hole portions 32 are arrayed in the following array directions: the direction of the line A-A of (a) of FIG. 1; and two directions obtained by rotating this direction clockwise and counterclockwise, respectively, by 60 degrees. Accordingly, the fixed electrode 23*a* is in a regular hexagonal shape having six sides, two of which extend parallel to one of these three directions, another two of which extend parallel to another one of these three directions, and the other two of which extend parallel to the other one of these three directions. In this case, such a geometric arrangement makes it easy to design a mask shape for the fixed electrode 23*a*.

Moreover, in the acoustic sensor 11 of the present embodiment, as in the conventional acoustic sensor 111, the diameter of each of the sound hole portions 32 is approximately 16 μm, and the distance between the centers of sound hole portions 32 adjacent to each other is shorter than twice the diameter of each of the sound hole portions 32. This results in an arrangement of a large number of sound hole portions 32 each having a large-diameter hole, thus improving the efficiency with which the acoustic wave from the outside reaches the vibrating membrane 22 through the sound hole portions 32 and enabling an improvement in SNR. Note that a similar effect can be achieved as long as the diameter of each of the sound hole portions 32 is approximately 6 μm or larger. Moreover, an upper limit of the diameter of each of the sound hole portions 32 depends on the strength of the fixed membrane 23 and the capacitance needed.

An increase in the diameter of each sound hole portion 32 or an increase in the number of sound hole portions 32 arranged leads to a decrease in the strength of the fixed membrane 23 or a decease in the capacitance between the vibrating electrode 22*a* and the fixed electrode 23*a*. Hence, it is desirable to consider these matters in determining the diameter of each sound hole portion 32 and the number of sound hole portions 32 to be arranged.

A method for manufacturing the acoustic sensor 11 of the present embodiment is different from a method for manufacturing the conventional acoustic sensor 111 only in the shape of the mask for forming the fixed electrode 23*a*, and is similar thereto in other aspects.

That is, first, a sacrifice layer ($SiO_2$) is formed on an upper surface of a monocrystalline silicon substrate that is to serve as the semiconductor substrate 21. Next, on the sacrifice layer, a polycrystalline silicon layer is formed, and then etched, whereby the vibrating membrane 22 is formed. Next, another sacrifice layer is formed so as to cover the vibrating membrane 22. Next, a polycrystalline silicon layer and a silicon nitride layer are formed so as to cover the sacrifice layer, and then etched, whereby the fixed membrane 23 including the fixed electrode 23*a* and the protecting membrane 23*b* is formed.

Next, the above-described monocrystalline silicon substrate is etched, whereby the opening 31 is formed. Then, the sacrifice layer is etched through the sound hole portions 32, whereby an air gap between the vibrating membrane 22 and the fixed membrane 23 is formed, the insulating layer 30 is formed, and the acoustic sensor 11 is completed.

[Embodiment 2]

Figure 4:
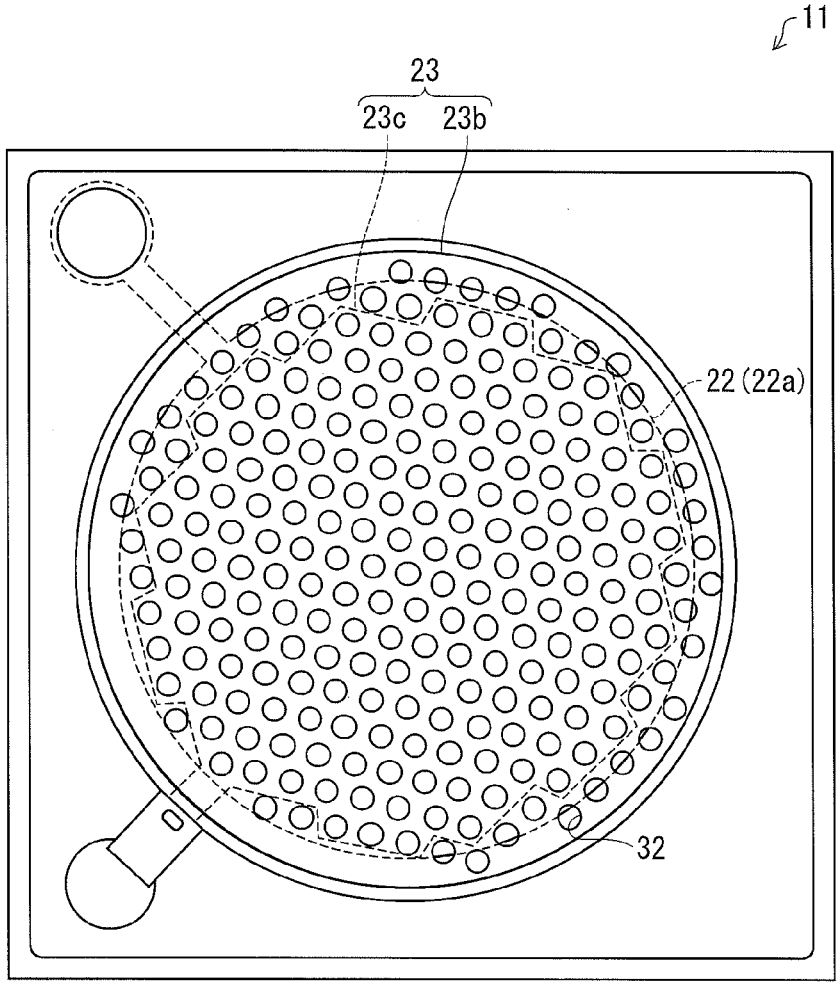
FIG. 4

Next, another embodiment of the present invention is described with reference to FIG. 4. FIG. 4 is a plan view schematically showing a configuration of an acoustic sensor 11 according to the present embodiment. The acoustic sensor 11 shown in FIG. 4 is different from the acoustic sensor 11 shown in FIG. 1 only in the shape of the fixed electrode, and the other components of the acoustic sensor 11 shown in FIG. 4 are the same as those of the acoustic sensor 11 shown in FIG. 1.

As shown in FIG. 4, a fixed electrode 23*c* of the present embodiment has a shape widened into a stepped shape more than that of the fixed electrode 23*a* shown in FIG. 1. In this case, the fixed electrode 23*c* is more similar in shape to the circular vibrating electrode 22*a* than to the fixed electrode 23*a* shown in FIG. 1. This makes it possible to suppress a decrease in capacitance.

[Embodiment 3]

Figure 5A:
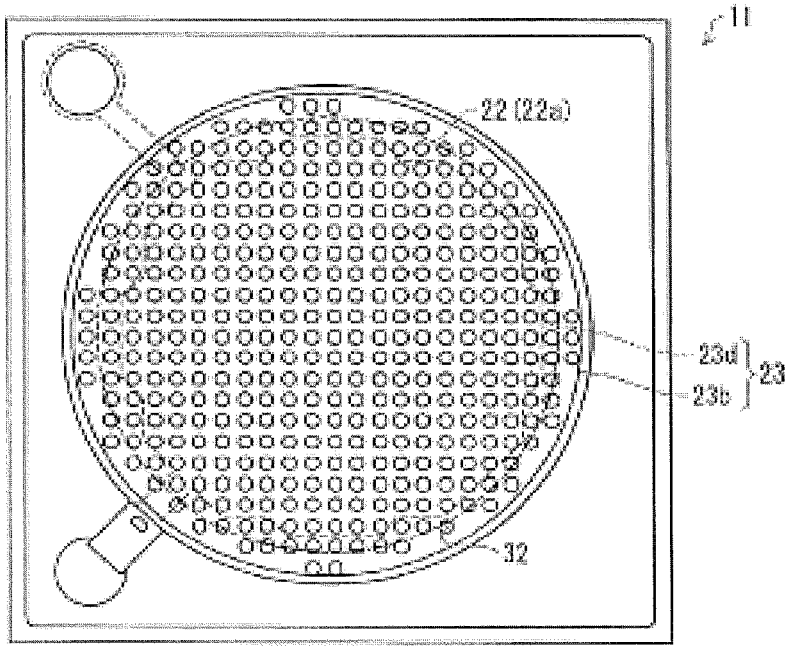
FIG. 5
Figure 5B:
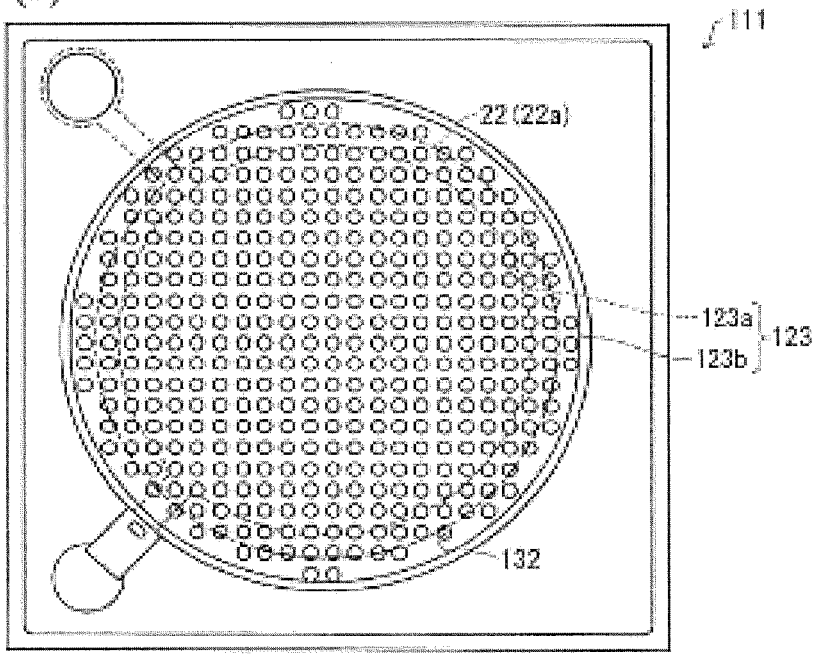
FIG. 5(b) PRIOR ART

Next, still another embodiment of the present invention is described with reference to FIG. 5. FIG. 5 is a set of plan views (a) and (b), (a) schematically showing a configuration of an acoustic sensor 11 according to the present embodiment, (b) schematically showing a configuration of a conventional acoustic sensor 111 serving as a comparative example of the acoustic sensor 11. The acoustic sensors 11 and 111 shown in FIG. 5 are different from the acoustic sensors 11 and 111 shown in FIGS. 1 and 8 in the array directions of the sound hole portions 32 and 132 and, therefore, in the shape of each fixed electrode of the present embodiment. The other components of the acoustic sensors 11 and 111 shown in FIG. 5 are the same as those of the acoustic sensors 11 and 111 shown in FIGS. 1 and 8.

In comparison with a conventional fixed electrode 123*a* shown in (b) of FIG. 5, a fixed electrode 23*d* shown in (a) of FIG. 5 is formed so that a boundary of an edge portion 40 of the fixed electrode 23*d* does not intersect the sound hole portions 32. This makes it possible to avoid damage due to a stress concentration on the edge portion 40 of the fixed electrode 23*d* and, accordingly, improve resistance to impact.

Moreover, as shown in (a) and (b) of FIG. 5, the sound hole portions 32 and 132 are arrayed in the following two array directions: the illustrated vertical direction; and a horizontal direction obtained by rotating the vertical direction by 90 degrees. Accordingly, the fixed electrode 23*d* of the present embodiment is in a shape having sides each extending parallel to any one of the following directions: these two directions; and directions each bisecting an angle formed by the two directions (i.e., diagonal directions obtained by rotating the illustrated vertical direction clockwise and counterclockwise, respectively, by 45 degrees). This makes it easy to design a mask shape for the fixed electrode 23*d*. Furthermore, since the fixed electrode 23*d* of the present embodiment is in a stepped shape, the fixed electrode 23*d* is similar in shape to the circular vibrating electrode 22*a*. This makes it possible to suppress a decrease in capacitance.

[Embodiment 4]

Figure 6:
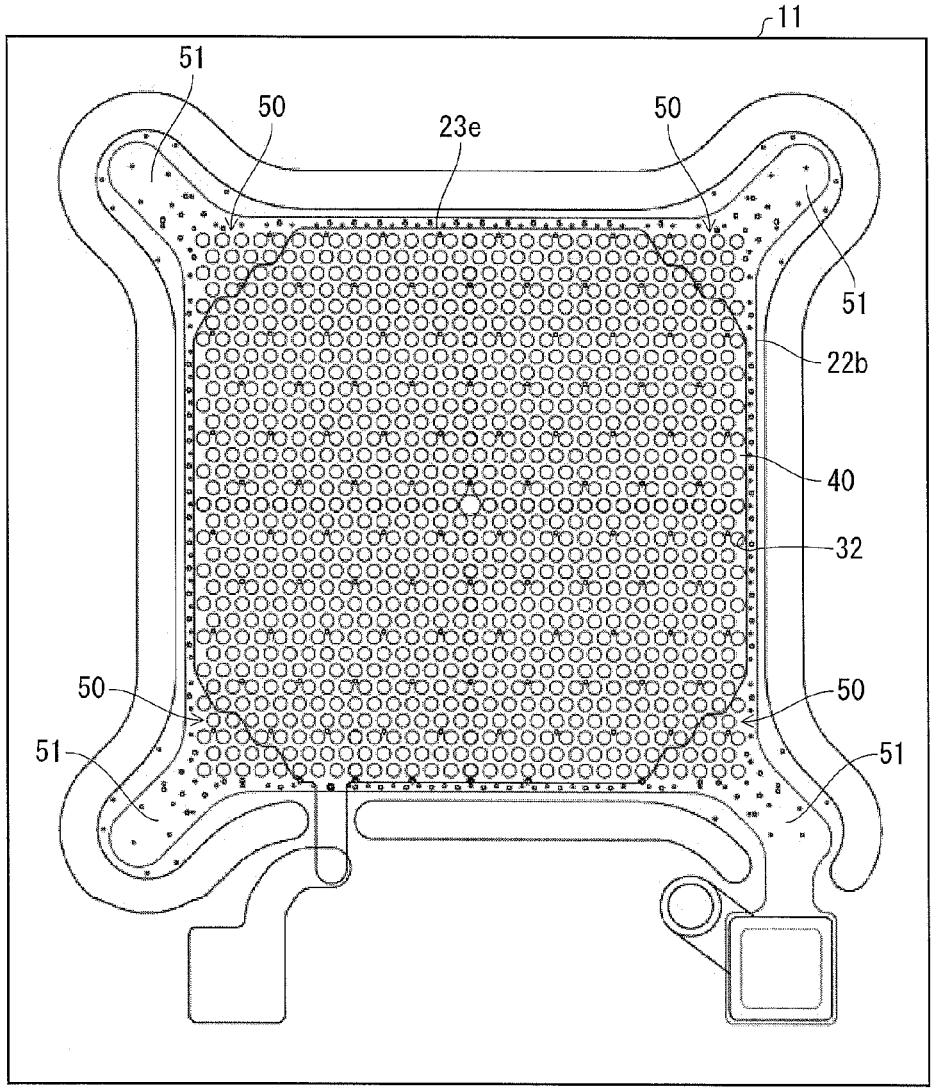
FIG. 6

Next, another embodiment of the present invention is described with reference to FIGS. 6 and 7. FIG. 6 is a plan view schematically showing a configuration of an acoustic sensor 11 according to the present embodiment. Note that FIG. 6 omits to illustrate the protecting membrane 23*b* of the fixed membrane 23.

The acoustic sensor 11 shown in FIG. 6 is different from the acoustic sensor 11 shown in FIG. 1 in the shape of the vibrating electrode and, therefore, in the shape of the fixed electrode. Note that the other components of the acoustic sensor 11 shown in FIG. 6 are the same as those of the acoustic sensor 11 shown in FIG. 1. A vibrating electrode 22*b* of the present embodiment has a square shape whose corner portions 50 are each extended outward from the center, and the vibrating electrode 22*b* is fixed to the semiconductor substrate 21 at such extended portions 51.

Figure 7:
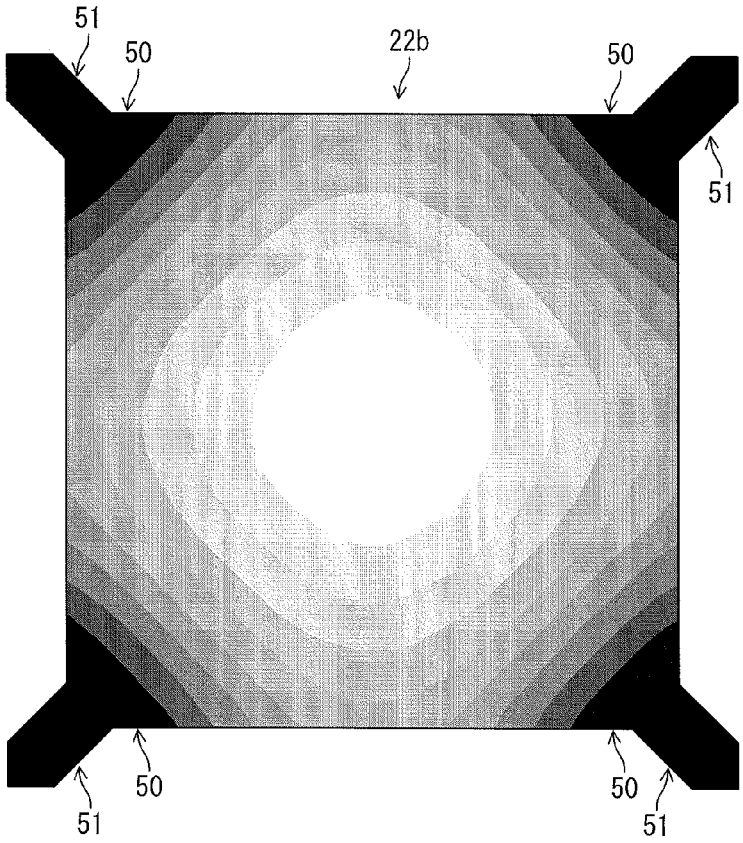
FIG. 7

FIG. 7 shows an amount of vibration of the vibrating electrode 22*b* thus configured, as obtained in the case of a predetermined acoustic wave having reached the vibrating electrode 22*b*. In FIG. 7, a smaller amount of vibration is indicated by a darker region, and a larger amount of vibration is indicated by a brighter region. As illustrated, the vibrating electrode 22*b* hardly vibrates at the corner portions 50 or at the extended portions 51. Hence, in the present embodiment, the fixed electrode 23*e* is in a shape obtained by omitting the corner portions 50 and the extended portions 51 from the vibrating electrode 22*b*.

As shown in FIG. 6, the fixed electrode 23*e* of the present embodiment is formed so that a boundary of an edge portion 40 of the fixed electrode 23*e* does not intersect sound hole portions 32. This makes it possible to avoid damage due to a stress concentration on the edge portion 40 of the fixed electrode 23*e* and, accordingly, improve resistance to impact.

Moreover, as shown in FIG. 6, the sound hole portions 32 are arrayed in the following two array directions: the illustrated horizontal direction; and directions obtained by rotating the horizontal direction clockwise and counterclockwise, respectively, by 60 degrees. Accordingly, the fixed electrode 23*e* of the present embodiment is in a shape having sides each extending parallel to any one of the following directions: these three directions; and directions each bisecting an angle formed by two directions adjacent to each other among these three directions (i.e., directions obtained by rotating the illustrated horizontal direction clockwise and counterclockwise, respectively, by 30 degrees, and the illustrated vertical direction). This makes it easy to design a mask shape for the fixed electrode 23*e*. Furthermore, since the fixed electrode 23*e* of the present embodiment is formed into a step shape on boundaries of the vibrating electrode 22*b* with the corner portions 50. Accordingly, the fixed electrode 23*e* is similar in shape to a vibrating portion of the vibrating electrode 22*b*. This makes it possible to suppress a decrease in capacitance.

The present invention is not limited to the description of the embodiments above, but may be altered in various ways within the scope of the claims. An embodiment based on a proper combination of technical means disclosed in different embodiments is encompassed in the technical scope of the present invention.

For example, in the embodiments described above, each of the sound hole portions 32 has a circular cross section, but may have a cross section of any shape such as a triangle or a quadrangle.

As described above, an acoustic transducer according to the present invention includes: a substrate; a vibrating membrane, formed above the substrate, which includes a vibrating electrode; and a fixed membrane, formed on an upper surface of the substrate, which includes a fixed electrode, the acoustic transducer converting an acoustic wave into an electrical signal according to a change in capacitance between the vibrating electrode and the fixed electrode, wherein the fixed membrane having a plurality of sound hole portions formed therein in order to allow the acoustic wave to reach the vibrating membrane from the outside, the fixed electrode being formed so that a boundary of an edge portion of the fixed electrode does not intersect the sound hole portions.

According to the above configuration, there is no sound hole portion intersecting the boundary of the fixed electrode on the edge potion of the fixed electrode. This makes it possible to avoid damage due to a stress concentration on the edge portion of the fixed electrode, and accordingly, improve resistance to impact.

The acoustic transducer according to the present invention is preferably configured such that in a case where the sound hole portions are regularly arrayed, the fixed electrode is in a shape having sides each extending along any one of the following directions: array directions of the sound hole portions; and directions each bisecting an angle formed by two array directions adjacent to each other among the array directions. In this case, it becomes easy to design the shape of the fixed electrode. Furthermore, it is preferable that the fixed electrode be in a stepped shape in order to be similar in shape to a vibrating portion of the vibrating electrode. Note that, examples of the array directions include the case where the array directions adjacent to each other form an angle of 60 degrees and the case where the array directions adjacent to each other form an angle of 90 degrees.

The acoustic transducer according to the present invention is preferably configured such that the sound hole portions are arranged so that a distance between centers of sound hole portions adjacent to each other is shorter than a sum of dimensions of the sound hole portions adjacent to each other. Further, the acoustic transducer according to the present invention is preferably configured such that each of the sound hole portions has a dimension of 6 μm or larger. In this case, the sound hole portions occupy a wider area. This improves the efficiency with which the acoustic wave from the outside reaches the vibrating membrane through the sound hole portions and enables an improvement in SNR (Signal-to-Noise Ratio). Note that an upper limit of the dimension of each of the sound hole portions depends on the strength of the fixed membrane and the required capacitance.

Note that there in an acoustic transducer in which the fixed membrane includes the fixed electrode and a protecting membrane wider than the fixed electrode, and the protecting membrane is in a stepped shape on the boundary of the edge portion of the fixed electrode. In this case, the stepped shape causes a stress concentration to occur at the boundary of the edge portion of the fixed electrode. Hence, it is preferable to apply the present invention to such an acoustic transducer.

Note that the same effects as those mentioned above can be brought about by a microphone including: an acoustic transducer configured as described above; and an output IC that amplifies the electrical signal from the acoustic transducer and outputs the electrical signal thus amplified to the outside.

Industrial Applicability

As described above, by having a fixed electrode formed so that a boundary of an edge portion of the fixed electrode does not intersect sound hole portions, an acoustic transducer according to the present invention can avoid damage due to a stress concentration on the edge portion of the fixed electrode and, accordingly, can be applied to an acoustic sensor, of any structure, which has sound hole portions in a fixed membrane.

Reference Signs

10 MEMS microphone
11 Acoustic sensor (acoustic transducer)
12 Output IC
13 Printed board
14 Cover
15 Through hole
21 Semiconductor substrate
22 Vibrating membrane
22*a*, 22*b* Vibrating electrode
23 Fixed membrane
23*a*, 23*c* to 23*e* Fixed electrode
23*b* Protecting membrane
30 Insulating layer
31 Opening
32 Sound hole portion
40 Edge portion
50 Corner portion
51 Extended portion

The invention claimed is:

1. An acoustic transducer comprising:
a substrate;
a vibrating membrane, formed above the substrate, which includes a vibrating electrode; and
a fixed membrane, formed on an upper surface of the substrate, which includes a fixed electrode, said acoustic transducer converting an acoustic wave into an electrical signal according to a change in capacitance between the vibrating electrode and the fixed electrode,
wherein the fixed membrane having a plurality of sound holes formed therein in order to allow the acoustic wave to reach the vibrating membrane from outside,
wherein the sound holes are arranged such that a distance between the centers of the sound holes adjacent to each other is shorter than a sum of diameters of the sound holes adjacent to each other,
wherein the fixed electrode being formed so that, when seen from an angle of a line normal to the surface of the substrate, a boundary of an edge portion of the fixed electrode does not intersect the sound holes, and
wherein the sound holes are arranged such that the sound holes are both inside and outside of the boundary of the edge portion.

2. The acoustic transducer according to claim 1, wherein
the sound holes are regularly arrayed, and
the fixed electrode is in a shape having sides each extending along any one of the following directions: array directions of the sound holes; and directions each bisecting an angle formed by two array directions adjacent to each other among the array directions.

3. The acoustic transducer according to claim 2, wherein the fixed electrode is in a stepped shape in order to be similar in shape to a vibrating portion of the vibrating electrode.

4. The acoustic transducer according to claim 2, wherein the array directions adjacent to each other form an angle of 60 degrees.

5. The acoustic transducer according to claim 2, wherein the array directions adjacent to each other form an angle of 90 degrees.

6. The acoustic transducer according to claim 1, wherein each of the sound holes has a diameter of 6 μm or larger.

7. The acoustic transducer according to claim 1, wherein
the fixed membrane includes the fixed electrode and a protecting membrane wider than the fixed electrode, and
the protecting membrane is in a stepped shape on the boundary of the edge portion of the fixed electrode.

8. A microphone comprising:
an acoustic transducer according to claim 1; and
an output IC that amplifies the electrical signal from the acoustic transducer and outputs the electrical signal thus amplified to the outside.

* * * * *